US010046190B2

(12) United States Patent
Polan et al.

(10) Patent No.: US 10,046,190 B2
(45) Date of Patent: Aug. 14, 2018

(54) HORIZONTAL SIDEWALL FIRE PROTECTION SPRINKLER

(71) Applicant: The Reliable Automatic Sprinkler Co., Inc., Liberty, SC (US)

(72) Inventors: George S. Polan, Liberty, SC (US); Juan Jimenez, Liberty, SC (US)

(73) Assignee: The Reliable Automatic Sprinkler Co., Inc., Liberty, SC (US)

( * ) Notice: Subject to any disclaimer, the term of this patent is extended or adjusted under 35 U.S.C. 154(b) by 0 days.

(21) Appl. No.: 15/500,841

(22) PCT Filed: Aug. 3, 2015

(86) PCT No.: PCT/US2015/043498
§ 371 (c)(1),
(2) Date: Jan. 31, 2017

(87) PCT Pub. No.: WO2016/019392
PCT Pub. Date: Feb. 4, 2016

(65) Prior Publication Data

US 2017/0216642 A1 Aug. 3, 2017

Related U.S. Application Data

(60) Provisional application No. 62/032,389, filed on Aug. 1, 2014.

(51) Int. Cl.
*A62C 37/08* (2006.01)
*A62C 37/09* (2006.01)
(Continued)

(52) U.S. Cl.
CPC ..... *A62C 37/09* (2013.01); *A62C 31/02* (2013.01); *A62C 31/03* (2013.01); *A62C 37/08* (2013.01); *A62C 37/11* (2013.01); *B05B 1/267* (2013.01)

(58) Field of Classification Search
CPC ..... A62C 37/09; A62C 31/02; A62C 31/03; A62C 37/08; A62C 37/11; B05B 1/267
(Continued)

(56) References Cited

U.S. PATENT DOCUMENTS 2,076,483 A 4/1937 Rowley
4,136,740 A 1/1979 Groos et al.
(Continued)

FOREIGN PATENT DOCUMENTS

CN 2 732 281 Y 10/2005
GB 2 488 505 A 8/2012
JP 2005-304887 A 11/2005

OTHER PUBLICATIONS

International Search Report and Written Opinion, dated Oct. 23, 2015, in International Patent Application No. PCT/US2015/043498.
(Continued)

*Primary Examiner* — Steven J Ganey
(74) *Attorney, Agent, or Firm* — Fitzpatrick, Cella, Harper & Scinto

(57) ABSTRACT

A horizontal sidewall fire protection sprinkler includes a sprinkler body, a sealing assembly, a sleeve body, a yoke, a load screw, levers, a soldered link, a slide plate, a deflector support member, a deflector, and a spring. When ambient temperature in an occupancy reaches a predetermined temperature, the soldered link fails, the levers release, and the yoke and the load screw are forced away from the sprinkler body. The spring forces the slide plate and the deflector support member away from an inner wall of the sprinkler body toward an opening at an outer end of the sleeve body, and the deflector support member and the deflector protrude from the outer end of the sleeve body. The sealing assembly is released from a sealed state, and the fire protection sprinkler outputs fluid from a fluid supply to the occupancy.

30 Claims, 15 Drawing Sheets

(51) Int. Cl.

| | |
|---|---|
| ***A62C 31/02*** | (2006.01) |
| *A62C 37/11* | (2006.01) |
| *A62C 31/03* | (2006.01) |
| *B05B 1/26* | (2006.01) |

(58) Field of Classification Search
USPC ..... 169/16, 37, 38, 40, 41; 239/498, 500
See application file for complete search history.

(56) References Cited

U.S. PATENT DOCUMENTS

| | | | | |
|---|---|---|---|---|
| 4,296,815 | A | 10/1981 | Mears | |
| 4,296,816 | A | 10/1981 | Fischer | |
| 4,570,720 | A | 2/1986 | Retzloff et al. | |
| 4,580,729 | A | 4/1986 | Pounder | |
| 4,596,289 | A | 6/1986 | Johnson | |
| 4,623,023 | A | 11/1986 | Retzloff et al. | |
| 4,987,957 | A | 1/1991 | Galaszewski | |
| 5,447,338 | A | 9/1995 | Kikuchi | |
| 5,722,599 | A | 3/1998 | Fries | |
| 5,810,263 | A | 9/1998 | Tramm | |
| 5,992,532 | A | 11/1999 | Ramsey et al. | |
| 6,024,174 | A | 2/2000 | Pierce | |
| 6,098,718 | A | 8/2000 | Sato | |
| 6,123,153 | A | 9/2000 | Finnegan | |
| 6,367,559 | B1 | 4/2002 | Winebrenner | |
| 6,481,644 | B1 | 11/2002 | Olsen | |
| 6,502,416 | B2 | 1/2003 | Kawasumi et al. | |
| 6,520,265 | B2 | 2/2003 | Winebrenner | |
| 6,520,565 | B1 | 2/2003 | Kjellberg | |
| 6,585,054 | B1 | 7/2003 | Thomas et al. | |
| 6,715,561 | B2 | 4/2004 | Franson | |
| 6,799,639 | B2 * | 10/2004 | Sato | A62C 31/02 169/37 |
| 6,848,513 | B2 | 2/2005 | Jackson et al. | |
| 6,854,668 | B2 | 2/2005 | Wancho et al. | |
| 6,918,545 | B2 | 7/2005 | Franson et al. | |
| 6,962,208 | B2 | 11/2005 | Franson et al. | |
| 7,036,603 | B2 | 5/2006 | Thomas et al. | |
| 7,137,455 | B2 | 11/2006 | Green | |
| 7,584,802 | B1 | 9/2009 | Fischer | |
| 7,614,457 | B2 | 11/2009 | Green | |
| 7,658,231 | B2 | 2/2010 | Rogers et al. | |
| 7,712,218 | B2 | 5/2010 | Franson et al. | |
| 7,712,543 | B2 | 5/2010 | Golinveaux | |
| 7,921,928 | B2 | 4/2011 | Thompson et al. | |
| 8,065,110 | B2 | 11/2011 | Golinveaux et al. | |
| 8,083,002 | B1 | 12/2011 | Golinveaux et al. | |
| 8,122,969 | B1 | 2/2012 | Fischer | |
| 8,127,860 | B2 | 3/2012 | Golinveaux | |
| 8,151,462 | B2 | 4/2012 | Franson et al. | |
| 8,281,810 | B2 | 10/2012 | Feenstra et al. | |
| 8,353,356 | B2 | 1/2013 | Rogers | |
| 8,376,061 | B2 | 2/2013 | Feenstra | |
| 8,387,711 | B2 | 3/2013 | Cordell et al. | |
| 8,402,657 | B2 | 3/2013 | Franson et al. | |
| 8,612,189 | B2 | 12/2013 | Golinveaux et al. | |
| 8,616,234 | B2 | 12/2013 | Ringer et al. | |
| 8,657,020 | B1 | 2/2014 | Fischer | |
| 8,662,190 | B2 | 3/2014 | Watson | |
| 8,725,457 | B2 | 5/2014 | Nikolayev et al. | |
| 8,960,319 | B2 * | 2/2015 | Orr | A62C 37/12 169/16 |
| 2002/0056763 | A1 | 5/2002 | Winebrenner | |
| 2007/0246231 | A1 * | 10/2007 | Pahila | A62C 31/02 169/37 |
| 2012/0024547 | A1 | 2/2012 | Orr et al. | |
| 2012/0267125 | A1 | 10/2012 | Abels et al. | |
| 2012/0286067 | A1 | 11/2012 | Orr et al. | |
| 2013/0292141 | A1 | 11/2013 | Senecal | |
| 2014/0076585 | A1 | 3/2014 | Abels et al. | |
| 2014/0174765 | A1 | 6/2014 | Miller et al. | |

OTHER PUBLICATIONS

International Preliminary Report on Patentability, dated Feb. 7, 2017, in international Patent Application No. PCT/US2015/043498.
Extended European Search Report dated Feb. 21, 2018, issued in corresponding European Patent Application No. 15827118.9.

* cited by examiner

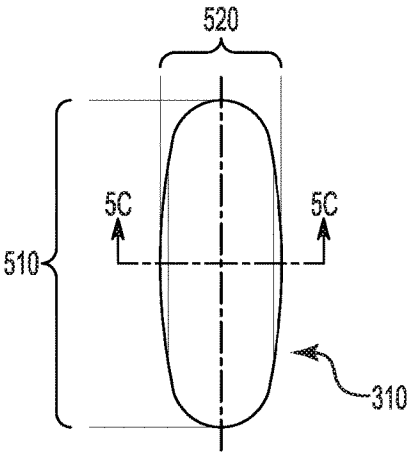
FIG. 5A
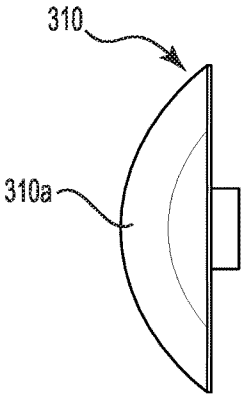
FIG. 5B
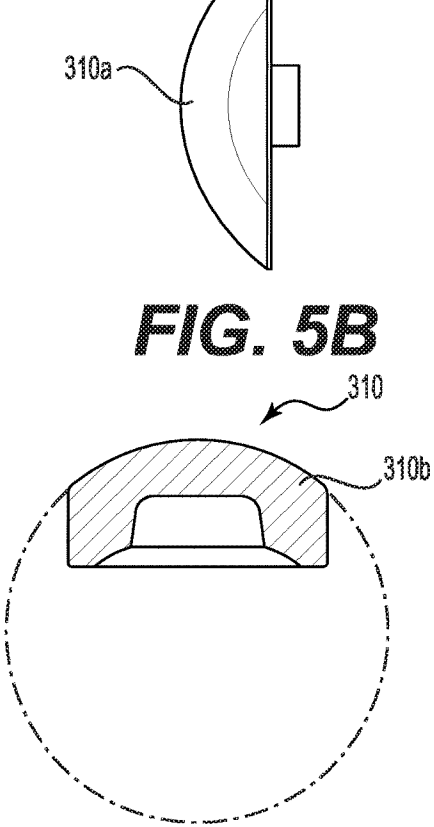
FIG. 5C
FIG. 5D

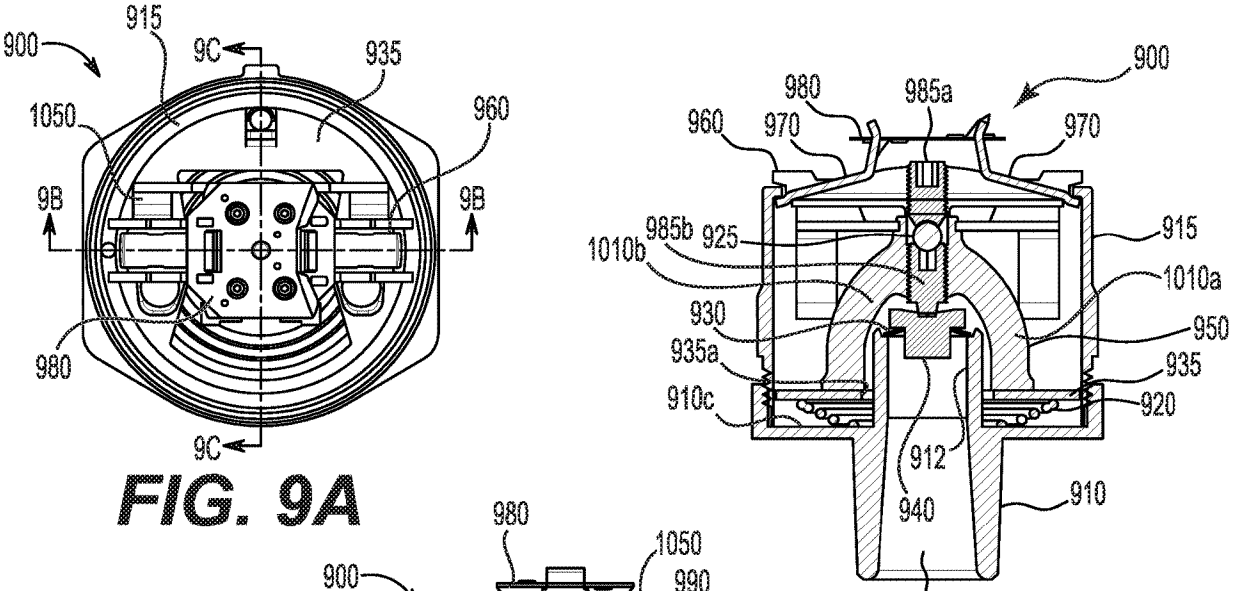
FIG. 9A
FIG. 9B
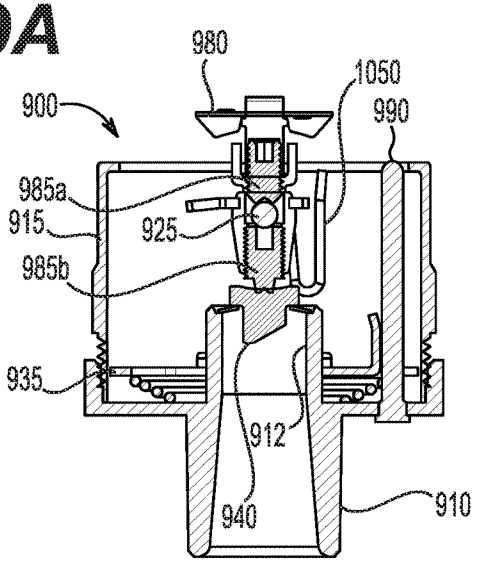
FIG. 9C

HORIZONTAL SIDEWALL FIRE PROTECTION SPRINKLER

RELATED APPLICATION

This application is a national stage entry under 35 U.S.C. §371 of International Patent Application No. PCT/US2015/043498, and claims the benefit of U.S. Provisional Patent Application No. 62/032,389, filed Aug. 1, 2014.

BACKGROUND

Field of Invention

Our invention relates to a horizontal sidewall fire protection sprinkler.

Fire protection sprinklers conventionally are connected to a conduit to receive a pressurized fire-extinguishing fluid, such as water. A typical fire protection sprinkler has a base with a threaded portion for connection to the conduit, and an output orifice to output the fluid-extinguishing fluid to provide fire control and/or fire suppression. The output orifice is sealed by a seal cap that is held in place by a release mechanism. The release mechanism is designed to release the seal cap under predetermined conditions, thereby initiating the flow of the fire-extinguishing fluid. A typical release mechanism includes a thermally-responsive element, e.g., a frangible bulb or a fusible link, and may include a latching mechanism.

Fire protection sprinklers may be mounted in a "horizontal sidewall" configuration, i.e., mounted to a wall, at a certain distance below a ceiling. A horizontal sidewall fire protection sprinkler has an output orifice that is oriented so as to output the fire-extinguishing fluid horizontally and spray the fire-extinguishing fluid onto an area to be protected that is primarily in front of the fire protection sprinkler. Horizontal sidewall fire protection sprinklers are particularly useful in applications in which overhead piping is not easily installed, e.g., in residential applications including hotels, dormitories, and private residences. Horizontal sidewall fire protection sprinklers may also be used in commercial applications, e.g., office buildings and retail spaces.

Horizontal sidewall fire protection sprinklers may project from a surface of the wall, or horizontal sidewall fire protection sprinklers may be recessed in the wall so that only a portion of the fire protection sprinkler projects beyond the surface of the wall. Alternatively, horizontal sidewall fire protection sprinklers may be designed to be concealed within the wall, for example, by a cover plate, prior to actuation of the fire protection sprinkler.

Underwriters Laboratories® Standard 199 (UL 199), published by Underwriters Laboratories®, on Northbrook, Ill., United States, specifies testing requirements for horizontal sidewall fire protection sprinklers used in commercial applications. Tests verify such features as the ability of the horizontal sidewall fire protection sprinkler to evenly distribute a fluid to a horizontal plane above a floor of a test room, and to distribute the fluid to walls of the test room. United States Underwriters Laboratories® Standard 1626 (UL 1626), also published by Underwriters Laboratories®, specifies testing requirements for horizontal sidewall fire protection sprinklers used in residential applications. Tests verify such features as the ability of the horizontal sidewall fire protection sprinkler to evenly distribute a fluid to a horizontal place above a floor of a test room, and to distribute at least twenty percent of the fluid discharged from the horizontal sidewall fire protection sprinkler to the walls of the test room, with each wall receiving a portion of the fluid that is proportional to a ratio of the length of the wall to a perimeter of the room. The size of the test room used for the UL 1626 fluid distribution tests is based on the coverage area of the horizontal sidewall sprinkler, where the coverage area consists of a rectangle having a length perpendicular to the surface of the wall in which the horizontal sidewall fire protection sprinkler is installed, and having a width parallel to the surface of the wall in which the horizontal sidewall fire protection sprinkler is installed.

SUMMARY

In a preferred embodiment of our invention described herein, a horizontal sidewall fire protection sprinkler is configured to change from a non-actuated state to an actuated state when ambient temperature in the occupancy reaches a predetermined temperature, and, when in the actuated state, to receive a fluid from a fluid supply and output the fluid to an occupancy in the actuated state. The fire protection sprinkler comprises a sprinkler body having an inlet, an outlet, and an inner wall, near the inlet, the inlet and the outlet defining a fluid passage. A sealing assembly has an outer surface that is configured to seal the outlet of the sprinkler body when the sealing assembly is in a sealed state and the fire protection sprinkler is in the non-actuated state. A sleeve body has an inner end that is secured to an outer surface of the sprinkler body, and an outer end with an opening. A yoke is mounted in the opening of the sleeve body, the yoke substantially spanning a diameter of the opening of the sleeve. A load screw is configured to be positioned in a loaded position, in which the load screw is urged by the yoke toward the outer surface of the sealing assembly, thereby holding the sealing assembly in the sealed state when the fire protection sprinkler is in the non-actuated state. Levers are configured to move from a retaining position, when the fire protection sprinkler is in the non-actuated state, in which the levers hold the yoke in the opening of the sleeve body and hold the load screw in the loaded position, and a released position, when the fire protection sprinkler is in the actuated state, in which the levers do not hold either of the yoke in the opening of the sleeve body and the load screw in the loaded position. A soldered link is configured to maintain the levers in the retaining position when the fire protection sprinkler is in the non-actuated state, and to fail when ambient temperature in the occupancy reaches the predetermined temperature and the fire protection sprinkler is in the actuated state, thereby releasing the levers so that the levers move from the retaining position to the released position. A slide plate is configured to move from a retracted position near the inner wall of the sprinkler body when the sprinkler is in the non-actuated state, to an extended position near the outlet of the sleeve body, and has an outer surface, and a central aperture that surrounds a portion of the fluid passage of the sprinkler body when the slide plate is in the retracted position. A deflector support member is connected to the outer surface of the slide plate and extends from the outer surface of the slide plate toward the opening at the outer end of the sleeve body. A deflector is mounted on the deflector support member and is positioned between the load screw and the outer surface of the sealing assembly. A spring is provided in the sprinkler body between the inner wall of the sprinkler body and the slide plate, the spring being configured to force the slide plate and the deflector support member away from the inner wall of the sprinkler body toward the opening of at the outer end of the sleeve body when the soldered link fails and the fire protection sprinkler is in the actuated state. When the fire protection sprinkler is in the actuated state, the deflector support member and the deflector protrude from outer end of the sleeve body.

According to another embodiment, the deflector support member includes at least one tower, and at least one guide pin that is slidably retained in the at least one tower. The at least one guide pin is configured to move from a retained position, in which the at least one guide pin is housed in the at least one tower, to an extended position, in which the at least one guide pin extends from the at least one tower. The deflector is mounted to the at least one guide pin. The slide plate has at least one aperture configured to retain the at least one tower, and, when the soldered link fails and the fire protection sprinkler is in the actuated state, the spring forces the at least one guide pin to move from the retained position to the extended position.

In yet another embodiment, the sealing assembly comprises a spring washer seated at the outlet of the sprinkler body, and a closure element received in the washer and sealing the outlet of the sprinkler body. When the fire protection sprinkler is in the non-actuated state, the load screw retains the closure element and the spring washer in a sealed position in the outlet of the sprinkler body.

In another embodiment, the sleeve body has a retaining flange that defines the opening at the outer end of the sleeve body. The yoke is self-centering and self-seating on the retaining flange, and has terraced tabs on both ends of the yoke, including a top tab that serves as a vertical seating medium, a middle tab that serves as a horizontal centering medium with an inner diameter of the retaining flange, and a bottom tab that serves as a load bearing medium for the levers when the levers are in the retaining position.

In another embodiment, the horizontal sidewall fire protection sprinkler further comprises a diffuser, attached to the deflector and positioned between the load screw and the seal assembly. The diffuser includes a convex solid portion positioned so that a center of the convex solid portion aligns with an axis of the fluid passage in the sprinkler body. When the fire protection sprinkler is in the non-actuated state, the diffuser transmits the force from the load screw to the seal assembly, and, when the fire protection sprinkler is in the actuated state and outputs the fluid received from the fluid supply, the fluid strikes the convex solid portion of the diffuser. The deflector may include a horizontally extending upper planar portion extending above the axis of the fluid passage, and a vertical portion having an aperture that is positioned above the convex solid portion of the diffuser and below the horizontally extending upper planar portion of the deflector relative to a direction of fluid flow along the axis of the fluid passage. When the fire protection sprinkler is in the actuated state, the fluid passes through the aperture of the vertical portion of the deflector. In addition, the vertical portion of the deflector may include one or more peripheral apertures, each of the one or more peripheral apertures being positioned downstream from the convex solid portion of the diffuser relative to the direction of fluid flow along the axis of the fluid passage.

The fire protection sprinkler is one of a residential sidewall fire protection sprinkler, a sidewall standard spray fire protection sprinkler, or an extended coverage sidewall spray fire protection sprinkler. The fire protection sprinkler may be installed in any one of a residential occupancy, a light hazard occupancy, or an ordinary hazard occupancy, as defined by United States National Fire Protection Association 13, Standard for the Installation of Sprinkler Systems (NFPA 13).

The fire protection sprinkler can have a nominal K-factor of 4.2 gpm/psi$^{1/2}$, 5.6 gpm/psi$^{1/2}$, or 8.0 gpm/psi$^{1/2}$.

In some embodiments, the fire protection sprinkler can provide standard spacing as defined by NFPA 13. In other embodiments, the fire protection sprinkler can provide a coverage area of one of at least 2.44 meters by 2.44 meters and up to and including 4.88 meters by 6.10 meters, at least 2.44 meters by 2.44 meters and up to and including 5.49 meters by 6.71 meters, and at least 2.44 meters by 2.44 meters and up to and including 4.88 meters by 7.32 meters.

In some embodiments, a minimum flow rate of the fire protection sprinkler is one of at least 45.42 liters per minute, and at least 98.42 liters per minute.

In some embodiments, a minimum pressure of the fire protection sprinkler is one of at least 56.54 kilopascals, at least 73.08 kilopascals, and 1206.58 kilopascals or less.

In another embodiment, the deflector support member comprises a frame. The frame is wishbone shaped, having two arms that are attached to the slide plate, and having a top portion that is attached to the deflector. A width of the arms of the frame may be equal to a width of a side of the deflector that is parallel to the arms. The fire protection sprinkler is configured to be installed in a wall of an occupancy, and, when the fire protection sprinkler is in the non-actuated state, the fire protection sprinkler is configured to sit within a recess having a depth of 88.9 mm formed between 38 mm by 89 mm studs in the wall.

In the preferred embodiment, when the soldered link fails and the fire protection sprinkler is in the actuated state, the levers are released from the retaining position to the released position, thereby releasing the yoke and the load screw, and a force of the fluid moves the yoke and the load screw out of and away from the fire protection sprinkler, the force of the spring moves the slide plate outward, from the inner wall of the sprinkler body toward the opening of the sleeve body, and the force of the fluid moves the deflector away from the slide plate to a protruded position relative to the outer end of the sleeve body.

In another embodiment, the horizontal sidewall fire protection sprinkler includes a subassembly including the at least one tower, the at least one guide pin, and the detector. The subassembly is configured to move from a housed position, in which the subassembly is housed within the sleeve body and the at least one guide pin is housed within the at least one tower, to a partially-protruded position, in which the at least one tower protrudes partly from the sleeve body, the at least one guide pin is in the retained position within the at least one tower, and the detector is spaced from the sleeve body an initial protrusion distance. In addition, the subassembly is configured to move from the partially-protruded position to a fully-protruded position, in which the at least one tower protrudes partly from the sleeve, the at least one guide pin is in the extended position, and the detector is spaced from the sleeve body a final protrusion distance that is greater than the initial protrusion distance.

According to one embodiment, the at least one guide pin is inserted through the at least one aperture on the slide plate and is secured to the slide plate with a nut. In another embodiment, the horizontal sidewall fire protection sprinkler includes a ball that is provided between the load screw and the closure element, and, when the fire protection sprinkle is in the non-actuated state the load screw via the ball the and closure element causes the sprinkler washer to detect. The diffuser of the fire protection sprinkler may have an oblong shape. In addition, a length of the diffuser is greater than a width of the diffuser. In one embodiment, a bottom edge of the vertical portion of the detector may include a conical slot. In addition, an edge of the horizontally extending upper planar portion of the detector that is closest to the sprinkler body includes a slot. In another embodiment, the arms of the frame are attached to the slide plate by rivets. According to one embodiment, a width of each of the arms of the frame is greater than a width of a side of the detector that is parallel to the arms of the frame.

Further features and advantages, as well as the structure and operation of various embodiments herein, are described in detail below with reference to the accompanying drawings. The teachings claimed and/or described herein are further described in terms of examples of the embodiments of our invention. These examples are described in detail with reference to the drawings, and it should be understood that the attached drawings serve to explain the functionality of the examples described herein. The architecture of this disclosure is sufficiently flexible and configurable, such that it can be used in ways other than those shown in the drawings. In addition, these embodiments are non-limiting embodiments, in which like reference numerals represent similar structures throughout the several views of the drawings.

BRIEF DESCRIPTION OF THE DRAWINGS

FIGS. 5A to 5D are a top view, a side view, a cross-sectional view taken along section line 5C-5C, and a detail view of the diffuser shown in FIGS. 3A to 3C.

FIG. 8B shows a detail view of a portion of the deflector shown in FIG. 8A, and FIG. 8D shows a cross-sectional view taken along section line 8D-8D of the deflector shown in FIG. 8C.

FIG. 9A is a top view of a horizontal sidewall fire protection sprinkler according to yet another embodiment herein, and FIGS. 9B and 9C are cross-sectional views taken along section lines 9B-9B and 9C-9C, respectively, of the horizontal sidewall fire protection sprinkler shown in FIG. 9A.

FIG. 11B shows a detail view of a portion of the deflector shown in FIG. 11A, and FIG. 11D shows a cross-sectional view taken along section line 11D-11D of the deflector shown in FIG. 11C.

Figure 1A:
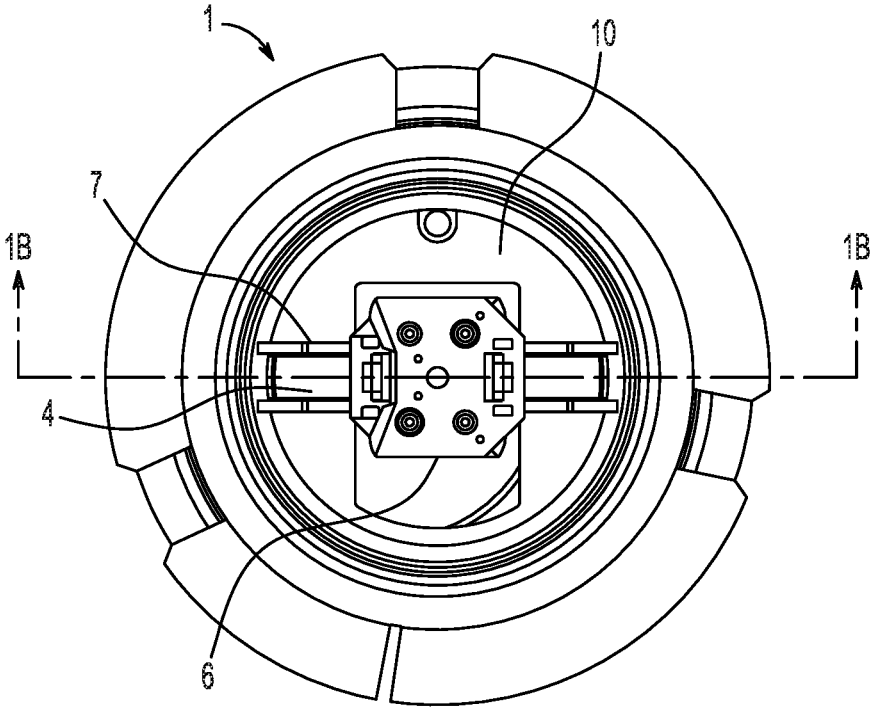
FIG. 1A is a top view of a horizontal sidewall fire protection sprinkler according to an embodiment.

Any reference numeral that appears in different figures represents the same element in those figures, even if that element is not described separately with respect to each figure. It should be noted that most of the figures that form part of this disclosure show the outlet of the sprinkler body of the fire protection sprinkler facing upward. The outlet, however, would be oriented to face sideward (i.e., the outlet would be positioned for output of water horizontally). In addition, except where otherwise noted, all directional references to up and down, top and bottom, or upper and lower, etc., relate to the orientation of the drawing being referenced, and not necessarily to the orientation of the fire protection sprinkler when installed.

DETAILED DESCRIPTION

Figure 1B:
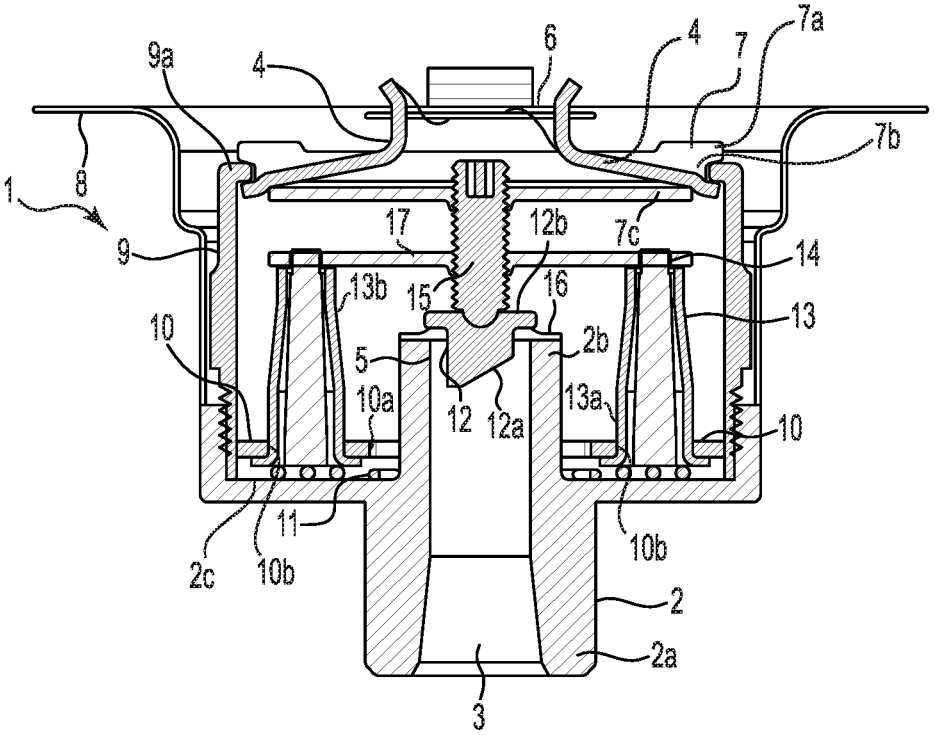
FIG. 1B is a cross-sectional view taken along section line 1B-1B of the horizontal sidewall fire protection sprinkler shown in FIG. 1A.

An actuation structure and mechanism of a horizontal sidewall fire protection sprinkler according to one embodiment is shown in FIGS. 1A and 1B. The horizontal sidewall fire protection sprinkler is preferably installed as a concealed fire protection sprinkler and may be constructed in different sizes, most preferably with a K-factor (a term known in the art, and defined by $K=Q/(\sqrt{p})^{1/2}$, where Q is the flow rate of fluid flowing from the outlet of the fire protection sprinkler in gallons per minute, and p is the residual pressure at the inlet of the fire protection sprinkler in pounds per square inch) of 4.2, 5.6, or 8.0 $gpm/psi^{1/2}$, although the K-factor is not limited to this range of values. That is, fire protection sprinklers having K factors from at least 2 $gpm/(psi)^{1/2}$ to 25 $gpm/psi^{1/2}$ or more are within the scope of the invention. The horizontal fire protection sidewall sprinkler, according to this embodiment, may be useful in light hazard, ordinary hazard, and residential applications. These terms are also known in the art.

As shown in FIG. 1B, a horizontal sidewall fire protection sprinkler 1 has a sprinkler body 2 provided with an inlet passage 3 near an inlet end 2*a* that connects to a conduit (not shown) for supply of a pressurized fire-extinguishing fluid, such as water. An outlet 5 is at an outlet end 2*b* of the sprinkler body 2, and is closed (i.e., sealed) by a seal assembly that includes a spring washer 16 seated in the outlet, and a closure element 12 received in the washer 16. As shown in FIG. 1B, a lower portion 12*a* (i.e., an inner surface) of the closure element 12 has an oblique shape. The seal assembly keeps the outlet 5 of the sprinkler body 2 closed prior to actuation of the fire protection sprinkler 1, as described in more detail below.

The fire protection sprinkler also has a sleeve body 9 secured to the sprinkler body 2 by means of, for example, threads. A slide plate 10, described in more detail below, is located near an upper surface 2*c* of the sprinkler body 2 (in the unactuated state), and has a central aperture 10*a* to allow the slide plate 10 to fit over the outlet end 2*b* of the sprinkler body 2, as shown in FIG. 1B. Two additional apertures 10*b* are provided in the slide plate 10 to receive towers 13, each tower 13 having a lower portion 13*a* that is approximately cylindrical, and an upper portion 13*b* that is conical. The towers 13 each house a guide pin 14, and the two guide pins 14 connect to and support a deflector 17 (shown in FIGS. 1B and 12-14).

A yoke 7 spans most of the width of an interior of the sleeve body 9, and urges a load screw 15 downward against an upper surface 12*b* of the closure element 12, as shown in FIG. 1B. The yoke 7 is held in place prior to actuation by two levers 4 that are joined by a soldered link 6. A spring 11, for example, a conical compression spring, is provided in the sprinkler body 2, between the upper surface 2*c* of the sprinkler body 2 and the slide plate 10, and presses the slide plate 10 and the guide pins 14 upward. The spring 11 is shown in a flat compressed state in FIG. 1B.

When the fire protection sprinkler 1 is fully assembled and in an unactuated state, as shown, for example, in FIG. 1B and described below, deflector 17 is positioned between the load screw 15 and the closure element 12. The load screw 15 thus also presses the slide plate 10 toward the upper surface 2*c* of the sprinkler body 2.

As known by those skilled in the art, failure of the soldered link 6 may occur due to ambient temperature reaching a predetermined temperature, and results in the release of the levers 4, the yoke 7, the load screw 15, and the closure element 1, as each element is forced out of and away from the fire protection sprinkler 1 by a force of the fluid. In addition, at this time, the force of the fluid moves the deflector 17 away from the slide plate 10 (in an upward direction in FIG. 1B), and the spring 11 forces the slide plate 10 outward from a wall in which the fire protection sprinkler 1 is installed, forcing the guide pins 14 to extend from the towers 13, and moving the deflector 17 to a fully extended position to deliver the fluid to the protected area in a spray pattern.

In this embodiment, instead of using relatively long guide pins 14, the guide pins 14 are relatively short and are made stationary by directly attaching the guide pins 14 to the slide plate 10. Nonetheless, it is within the scope of the invention to use relatively long guide pins 14.

A flat concealed cover plate 8 conceals the fire protection sprinkler 1 hen the fire protection sprinkler 1 is unactuated, as shown in FIG. 1B.

Figure 12:
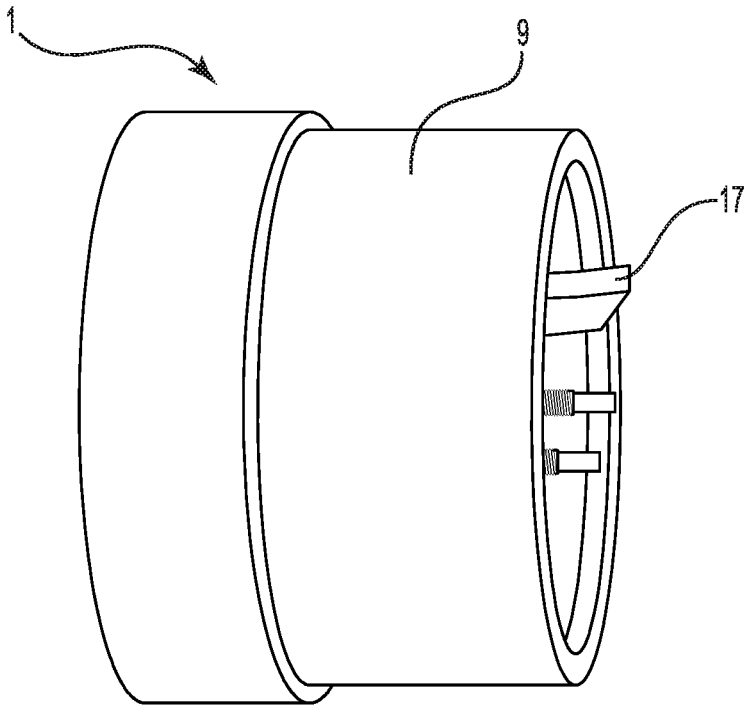
FIGS. 12 to 14 are isometric views of the horizontal sidewall fire protection sprinkler shown in FIGS. 1A and 1B in different stages of deployment.
Figure 13:
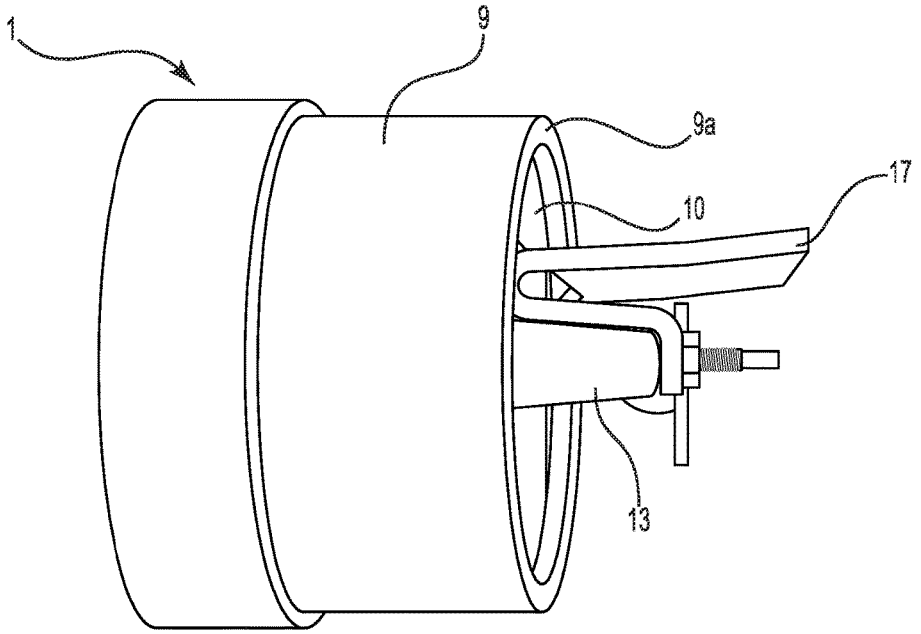
Figure 14:
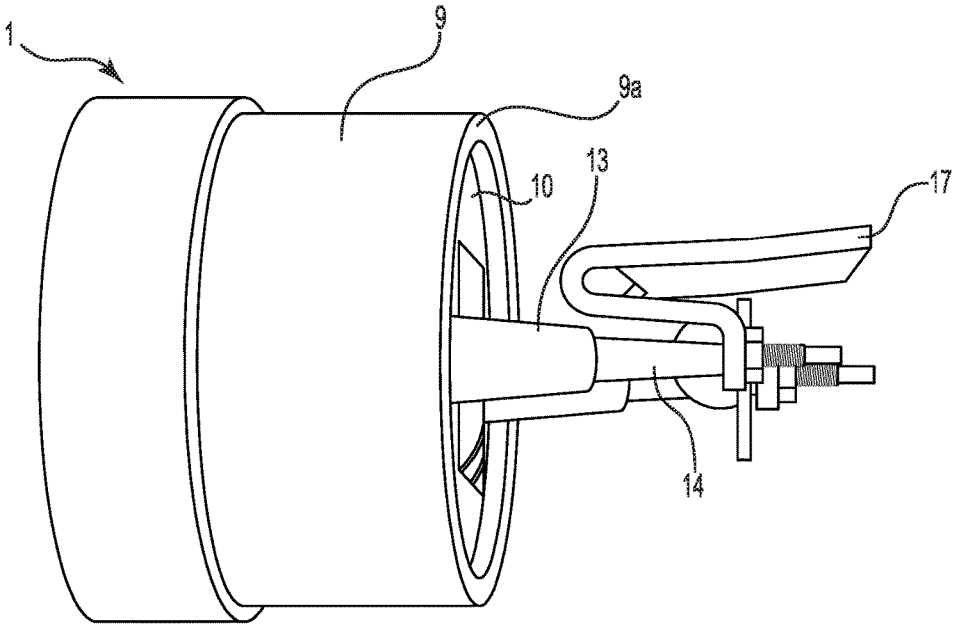

This embodiment provides for two phases of deflector deployment after the soldered link 6 fails, and the yoke 7, the levers 4, and the closure element 12 are forced away (i.e., ejected) from the sprinkler body 2, as shown in FIGS. 12 to 14. In particular, FIG. 12 shows the fire protection sprinkler 1 prior to deflector deployment, and after failure of the soldered link 6, and ejection of the yoke 7, the levers 4, and the closure element 12. FIG. 13 shows the first phase of deflector deployment (note that a portion of the deflector 17 rests on the tower 13). FIG. 14 shows the second phase of deflector deployment (note that the guide pin 14 protrudes from the tower 13, and the deflector 17 is completely outside of the sleeve body 9).

This double phase deployment assures that the deflector 17 achieves sufficient protrusion from a surface of the wall, and allows water to wet adjacent corners in an area to be protected to at least 0.763 meter (30 inches) above a floor elevation.

To further assure complete deployment of the deflector assembly, the spring 11 drives the slide plate 10 outward (toward the right, in FIG. 14) against a retaining flange 9*a* provided on the sleeve body 9.

The slide plate 10, the guide pins 14, the deflector 17, and the yoke 7 form a sub-assembly that, as discussed in the arrangement of this embodiment, can provide the following advantageous effects. Because the slide plate 10 slides forward (i.e., toward a right side in FIGS. 12-14), the deflector 17 protrudes an initial distance from the surface of the wall. Then, when the guide pins 14 slide in the towers 13 to a fully deployed position, the distance by which the deflector 17 protrudes from the surface of the wall increases. This arrangement reduces an amount of water that is deflected back onto the surface of the wall (i.e., a back wall water wash) to a satisfactory level. The guide pins 14 are retained by the towers 13, and both interface with each other via the taper-taper feature, as disclosed in commonly-assigned U.S. Pat. No. 6,554,077.

The yoke 7 is self-centering and self-seating within/on a retaining flange 9*a* of the sleeve body 9, and has terraced tabs on both ends, as shown in FIG. 1B. The terraced tabs include a top tab 7*a* that serves as a vertical seating medium, a middle tab 7*b* that serves as horizontal centering medium within an inner diameter of the retaining flange 9*a*, and a bottom tab 7*c* that serves as a load bearing medium for the levers 4. The top tab 7*a* and the middle tab 7*b* can greatly simplify the assembly process, thereby, reducing assembly time, and eliminating the potential for misalignment.

Figure 1D:
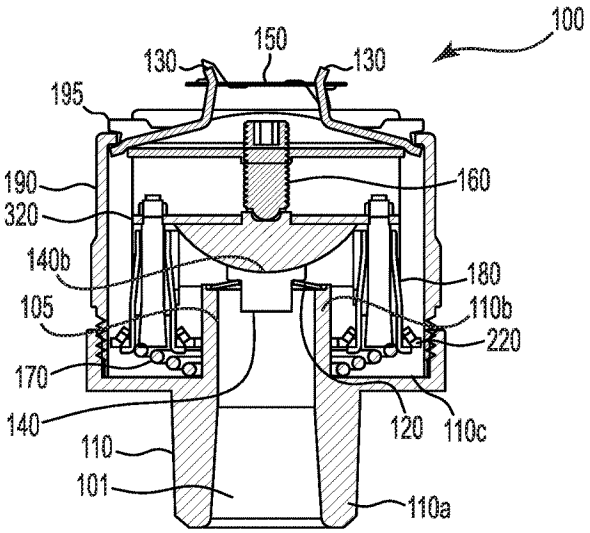
FIGS. 1D and 1E are cross-sectional views taken along section lines 1D-1D and 1E-1E, respectively, of the horizontal sidewall fire protection sprinkler shown in FIG. 1C.
Figure 1C:
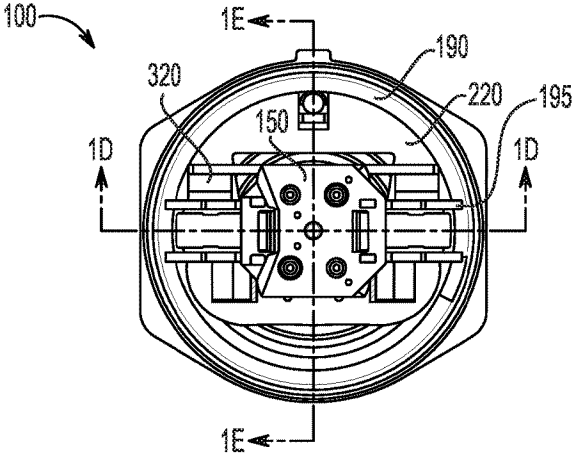
FIG. 1C is a top view of a horizontal sidewall fire protection sprinkler according to another embodiment.
Figure 1E:
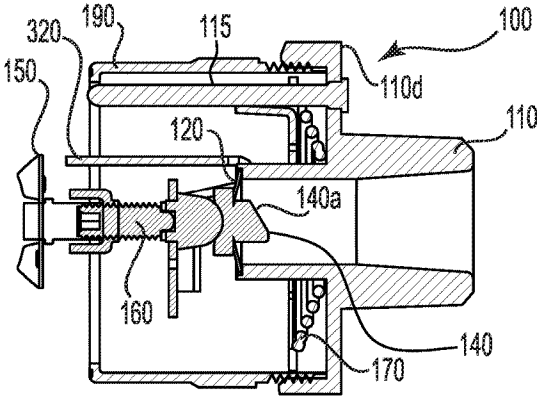

FIGS. 1C to 1E show a horizontal sidewall fire protection sprinkler 100 according to another embodiment. Similar to the fire protection sprinkler 1 described with reference to FIGS. 1A and 1B, the fire protection sprinkler 100, shown in FIG. 1D, has a sprinkler body 110 provided with an inlet passage 101, and an outlet 105 that is closed (i.e., sealed) by a seal assembly. The seal assembly includes a spring washer 120 seated at the outlet 105, and a closure element 140 received in the spring washer 120. As shown in FIG. 1E, the closure element 140 has an oblique lower surface 140*a* (i.e., the right-side surface in FIG. 1E), in part.

Figure 2B:
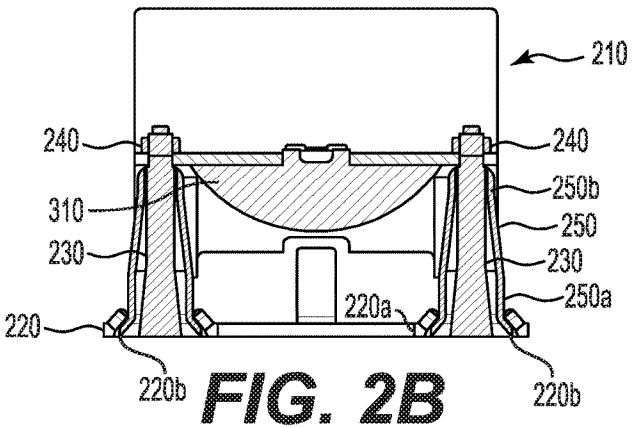
FIGS. 2A to 2C are a top view, a cross-sectional view taken along section line 2B-2B, and an isometric view, respectively, of a subassembly of a diffuser, a deflector, guide pins, and a slide plate of the horizontal sidewall fire protection sprinkler shown in FIGS. 1C to 1E.
Figure 2A:
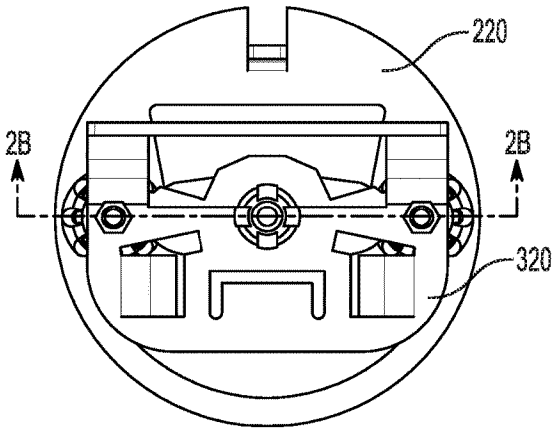
Figure 2C:
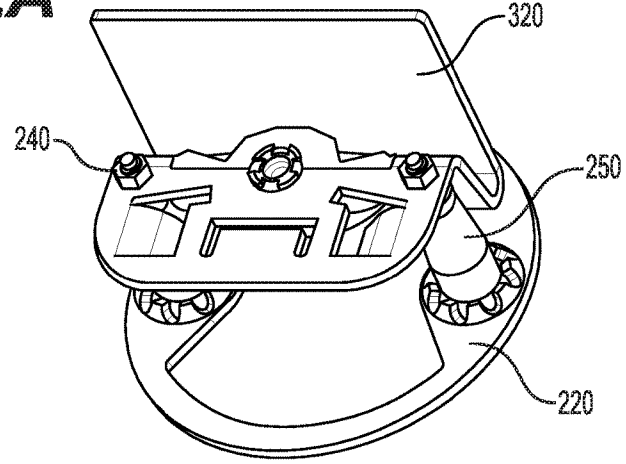

The fire protection sprinkler also has a sleeve body 190 secured to the sprinkler body 110, and a subassembly 180 that is shown in detail in FIGS. 2A to 2C. As shown in FIG. 2B, the subassembly 180 includes a slide plate 220 located near an upper surface 110*c* of sprinkler body 110 (in the unactuated state) when assembled with the sprinkler body 110, and having a central aperture 220*a* to allow the slide plate 220 to fit over an outlet end 110*b* of the sprinkler body 110, as shown in FIG. 1D. Two additional apertures are provided in the slide plate 220 to receive towers 250, each tower 250 having a lower portion 250*a* that is approximately cylindrical, and an upper portion 250*b* that is conical. The towers 250 each house a guide pin 230, and the guide pins 230 bear and support a deflector/diffuser subassembly 210 that is described below in more detail in connection with FIGS. 3A to 3C. The subassembly 180 is connected to the guide pins 230 via, for example, hexagonal nuts 240.

A yoke 195 spans most of the width of the interior of the sleeve body 190, and urges a load screw 160 downward (in FIG. 1D) toward an upper surface 140*b* of the closure element 140. The yoke 195 is held in place prior to actuation by two levers 130 that are joined by a soldered link 150. A spring 170, for example, a conical compression spring, is provided in the sprinkler body 110, between the upper surface 110*c* of the sprinkler body 110 and the subassembly 180. The spring 170 thus presses the slide plate 220 and the guide pins 230 upward (in FIG. 1D).

The deflector/diffuser subassembly 210 is positioned between the load screw 160 and the closure element 140 when the fire protection sprinkler 100 is unactuated. The load screw 160 thus also presses the slide plate 220 toward the upper surface 110*c* of the sprinkler body 110 (the upper surface of the sprinkler body 110, in the orientation of FIG. 1D).

Fusion of the soldered link 150 results in the release of the levers 130, the yoke 195, the load screw 160, and the closure element 140, as each element is forced out of and away from the fire protection sprinkler 100 by the force of the fluid. In addition, at this time, the spring 170 forces the slide plate 220 outward from the wall (upward in FIG. 1D), and forces the guide pins 230 to extend from the towers 250, moving the deflector/diffuser subassembly 210 to the proper position to deliver the fluid where needed. The fire protection sprinkler 100 further includes a guide pin 115, shown in FIG. 1E, that is fitted through a bottom surface 110*d* of the sprinkler body 110 into the sleeve body 190. The guide pin 115 helps to keep the slide plate 220 aligned during deployment of the deflector/diffuser subassembly 210 of the fire protection sprinkler 100.

Similar to the embodiment discussed above in connection with FIGS. 1A and 1B, this embodiment also provides for two phases of deflector deployment, after the soldered link 150 fails, and the yoke 195, the levers 130, and the closure element 140 are forced away (i.e. ejected) from the sprinkler body 110, assuring that the deflector/diffuser subassembly 210 achieves sufficient protrusion from a surface of the wall and allows the fluid (i.e., water) to wet adjacent corners to at least 0.763 meter (30 inches) above a floor elevation.

Figure 3B:
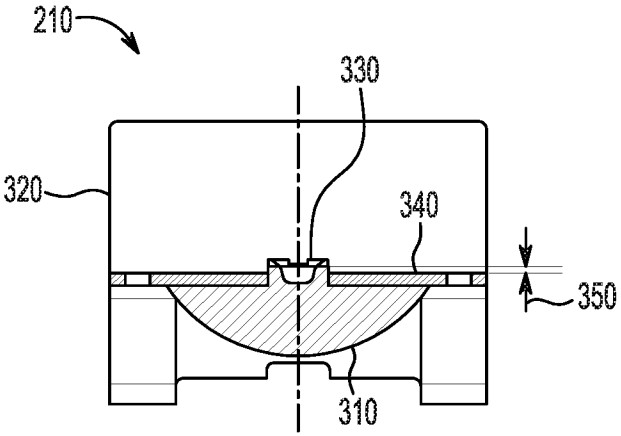
FIGS. 3A to 3C are a top view, a cross-sectional view taken along section line 3B-3B, and a detail view, respectively, of a subassembly of the diffuser and the deflector shown in FIGS. 2A to 2C.
Figure 3A:
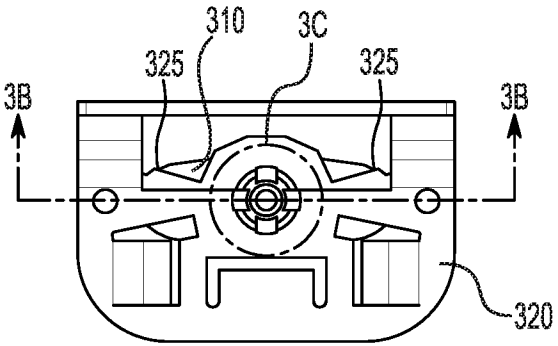
Figure 3C:
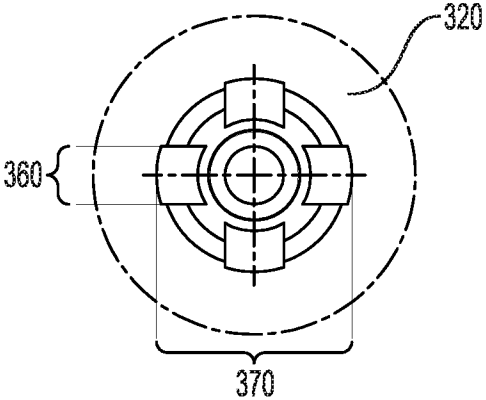
Figure 4C:
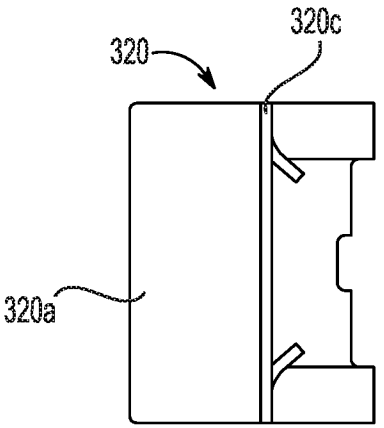
FIGS. 4A to 4E are various perspective views of the deflector shown in FIGS. 3A to 3C.
Figure 4B:
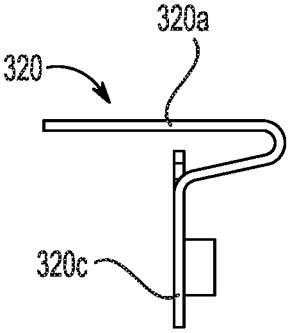
Figure 4A:
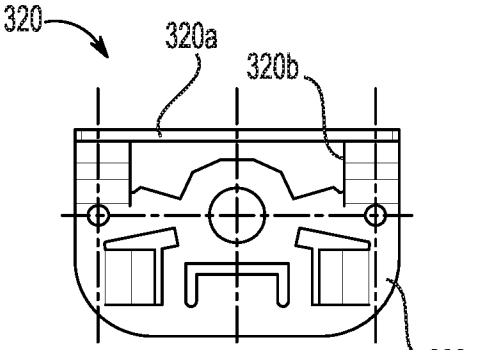
Figure 4E:
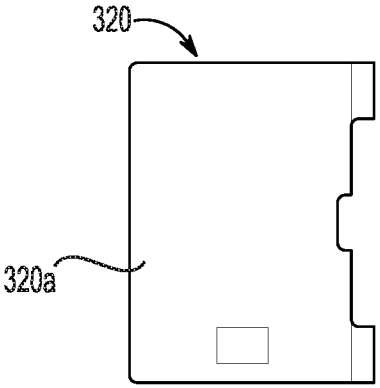
Figure 4D:
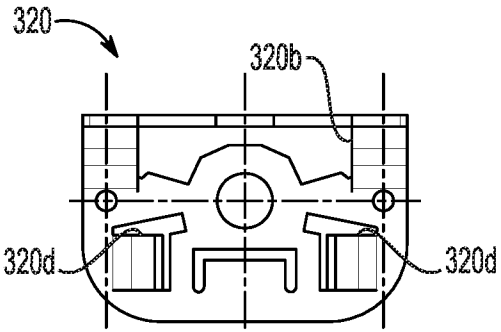

As shown in FIGS. 3A to 3C, the deflector/diffuser subassembly 210 includes a diffuser 310 that is rigidly staked by one or more stakes 330 to a deflector 320. The diffuser 310 is aligned with tips of the deflector 320 within, for example, a maximum of 0.254 mm (0.010 inch), as shown in FIG. 3A at reference numeral 325. A width 350 between a face 340 of the deflector and the stake 330 can be a minimum of 0.254 mm (0.010 inch). A flap width 360 of the stake 330 can be 2.03 mm (0.08 inch), and a diameter 370 of the stake 330 can be 6.60 to 6.73 mm (0.260 to 0.265 inch).

FIGS. 4A to 4E show various views of the deflector 320 shown in FIGS. 3A to 3C. The deflector 320 may, if desired, be identical to that described in Bulletin 148, "K-8.0 F1FR EC-9 Horizontal Sidewall Sprinkler", published by the Reliable Automatic Sprinkler Co., Inc., of Liberty, South Carolina, United States, although the invention is not limited to use of that deflector.

FIGS. 5A to 5D show various views of the diffuser 310 shown in FIGS. 3A to 3C. As shown in FIGS. 5A to 5D, the diffuser 310 includes a convex solid portion 310*a* that, prior to actuation, transmits the force of the load screw 160 to the closure element 140. During operation of the fire protection sprinkler 100, the fluid exiting the outlet 105 of the sprinkler body 110 strikes the convex solid portion 310*a* that provides the desired delivery of the fluid. A center of the convex sold portion 310*a* is located on the axis of the inlet passage 101 in the sprinkler body 110. A horizontally extending upper planar portion 320*a* of the deflector 320 extends above the axis of the inlet passage 101 when the fire protection sprinkler 100 is installed in a wall of an occupancy, and the fluid can pass the diffuser 310 through an aperture 320*b* in the deflector 320 that is provided (i) above the convex solid portion 210*a* of the diffuser 310 and (ii) below the upper planar portion 320*a* of the deflector 320. Additional apertures 320*d* are provided in a vertical portion 320*c* of the deflector 320 provided downstream from the convex solid portion 310*a* of the diffuser 310.

As shown in FIG. 5A, the diffuser 310 has a length 510 and a width 520. As shown in FIG. 5C, the diffuser 310 has a base 310*b* with a height 550, and a top portion 310*c* with a height 540, a top radius 530, and a bottom radius 560. This structure for the diffuser 310 provides particularly high performance, and the shape thereof is accordingly shown in its proper proportions (although the invention is not limited to the use of this exact structure).

The oblong shape of the diffuser 310 generates a sufficiently broad spray pattern that wets a far wall (i.e., a wall that opposes the wall in which the fire protection sprinkler 100 is installed) including both corners, several inches higher than the requirement set forth in UL 199 (i.e., higher than 0.763 meter (30 inches) above a floor elevation for an extended coverage light hazard (ECLH) type of fire protection sprinkler, for any room size up to 6.096 meters by 6.096 meters (20 feet by 20 feet)).

The fire protection sprinkler 100 is preferably an extended coverage sidewall spray fire protection sprinkler, as defined by NFPA 13, having a nominal K-factor of 8.0 gpm/psi$^{1/2}$, and permitted for use in light hazard occupancies. The fire protection sprinkler 100 can obtain a coverage area of 4.877 meters by 6.096 meters (16 feet by 20 feet). Further technical details of the fire protection sprinkler 100 are provided below in Tables 1 and 2. Of course, our invention is not limited by the technical details provided in these tables, and these tables are merely examples of this embodiment.

TABLE 1

| NOMINAL K-FACTOR | | THREAD | TEMPERATURE RATING | | MAXIMUM AMBIENT TEMPER- | MAXIMUM WATER WORKING | SPRINKLER IDENTIFICATION NUMBER |
|---|---|---|---|---|---|---|---|
| US | METRIC | SIZE | SPRINKLER | COVER | ATURE | PRESSURE | (SIN) |
| 8.0 | 115 | ¾" NPT or ISO 7-R¾ | 165° F. (74° C.) | 135° F (57° C.) | 100° F. (38° C.) | 175 PSI (12 bar) | RA4762 |

TABLE 2

| Coverage Area | | | | | | | |
|---|---|---|---|---|---|---|---|
| MAX. INSTALLED COVERAGE AREA WIDTH × LENGTH | | DEFLECTOR TO CEILING DIMENSION | | MIN. REQUIRED FLOW RATE | | MIN. REQUIRED PRESSURE | |
| FT. × FT. | M × M | IN-CHES | MM | GPM | L/MIN | PSI | BAR |
| 14 × 22 | 4.3 × 6.7 | 4-6 | 102-152 | 31 | 117.3 | 15.0 | 1.03 |
| 14 × 22 | 4.3 × 6.7 | 6-12 | 152-305 | 35 | 132.5 | 19.1 | 1.3 |
| 14 × 24 | 4.3 × 7.3 | 4-6 | 102-152 | 35 | 132.5 | 19.1 | 1.3 |
| 14 × 24 | 4.3 × 7.3 | 6-12 | 152-305 | 39 | 147.6 | 23.8 | 1.6 |
| 16 × 16 | 4.9 × 4.9 | 4-12 | 102-305 | 26 | 98.4 | 10.6 | 0.7 |
| 16 × 18 | 4.9 × 5.5 | 4-12 | 102-305 | 29 | 109.8 | 13.1 | 0.9 |
| 16 × 20 | 4.9 × 6.1 | 4-12 | 102-305 | 32 | 121.1 | 16.0 | 1.1 |
| 16 × 22 | 4.9 × 6.7 | 4-12 | 102-305 | 36 | 136.2 | 20.2 | 1.4 |
| 16 × 24 | 4.9 × 7.3 | 4-12 | 102-305 | 39 | 147.6 | 23.8 | 1.6 |
| 18 × 18 | 5.5 × 5.5 | 4-12 | 102-305 | 33 | 124.9 | 17.0 | 1.2 |
| 18 × 20 | 5.5 × 6.1 | 4-12 | 102-305 | 36 | 136.2 | 20.2 | 1.4 |
| 18 × 22 | 5.5 × 6.7 | 4-12 | 102-305 | 40 | 151.4 | 25.0 | 1.7 |

Figure 6B:
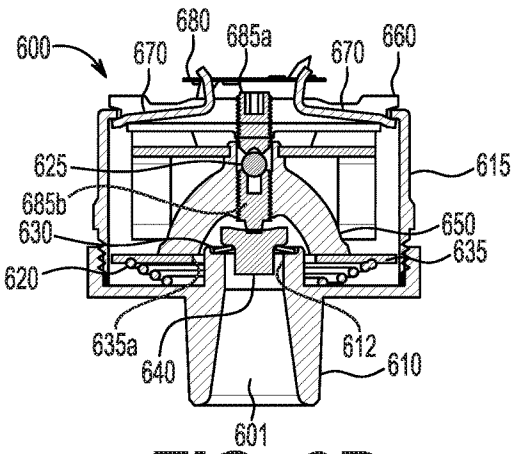
FIGS. 6B and 6C are cross-sectional views taken along section lines 6B-6B and 6C-6C, respectively, of the horizontal sidewall fire protection sprinkler shown in FIG. 6A.
Figure 6A:
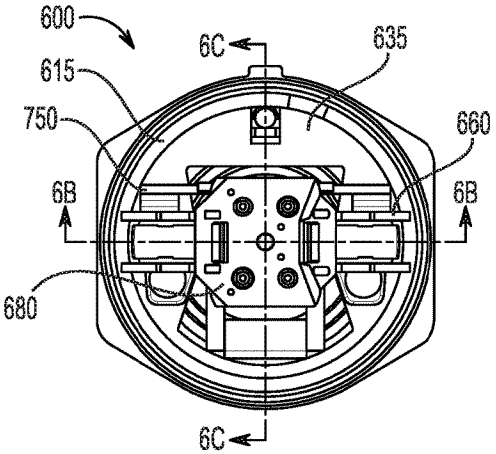
FIG. 6A is a top view of a horizontal sidewall fire protection sprinkler according to an embodiment herein.
Figure 6C:
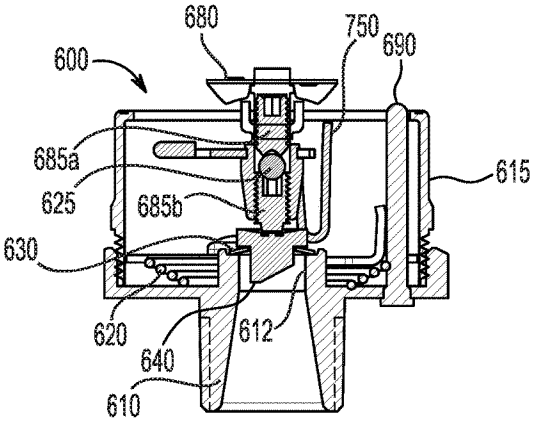

FIGS. 6A to 6C show a horizontal sidewall fire protection sprinkler 600 according to an additional embodiment. Similar to the fire protection sprinklers 1 and 100, discussed above, the fire protection sprinkler 600 includes a sprinkler body 610, an inlet passage 601, a sleeve body 615, and an outlet 612 that is sealed by a sealing assembly. The sealing assembly includes a spring washer 630 seated in the outlet 612, and a closure element 640 received in the spring washer 630 and sealing the outlet 612. The fire protection sprinkler 600 further includes a load screw 685, a yoke 660, two levers 670, and a soldered link 680. Each of these elements operates in a similar manner to the corresponding elements discussed above with respect to the fire protection sprinklers 1 and 100.

The fire protection sprinkler 600 differs from the fire protection sprinklers 1 and 100 in the structure of the deflector. In particular, the fire protection sprinkler 600 includes a slide plate 635 having a center aperture 635*a* for fitting over the outlet 612 of the sprinkler body 610. A subassembly 650, including a machined frame 710 and a deflector 750 (see FIGS. 7A to 7D), is attached to the slide plate 635. The frame 710 is machined in the shape of a wishbone and has two arms 710*a*, 710*b* that are attached to the slide plate 635 via, for example, rivets 730. A top portion 710*c* of the frame 710 opposite the two arms 710*a*, 710*b* is attached to the deflector 750. A height of the rivets 730 from the slide plate 635 is provided at reference numeral 715. The arms 710*a*, 710*b* of the frame 710 are substantially the same size as a side of the deflector 750 parallel to the arms.

In some embodiments, the fire protection sprinkler has a length measured along the axis between an inlet and an outlet of less than, for example, 57.15 mm (2.25 inches) prior to actuation, and increasing to more than 63.5 mm (2.50 inches) following actuation. The fire protection sprinkler has a coverage length and a coverage width, the coverage length being oriented in a direction parallel with the longitudinal axis between an inlet orifice and an outlet orifice, and the coverage length being oriented in a direction perpendicular to the axis between the inlet orifice and the outlet orifice. In these embodiments, the coverage length is more than 5.49 m (18 feet). The coverage length and coverage width define a coverage area, and the fire protection sprinkler delivers the fluid to a wall at the perimeter of the coverage area at a rate of not less than the flow rate of the fluid through the outlet orifice multiplied by 20 percent of the ratio between the length of the wall and the perimeter of the coverage area. In this regard, the fire protection sprinkler, prior to actuation, fits in a roughly 88.9 mm (3.50 inches) deep space formed by 38 mm by 89 mm studs (nominally 2 inches by 4 inches) in the wall.

A spring 620, for example, a conical spring is provided between the slide plate 635 and an inner wall of the sprinkler body 610 (towards the bottom of FIG. 6B), and forces the slide plate 635 away from the sprinkler body 610. Fusion of the soldered link 680 results in the release of the levers 670, the yoke 660, the load screw 685, and the closure element 640, as each element is forced out of and away from the fire protection sprinkler 600 by the force of the fluid. In addition, at this time, the spring 620 forces the slide plate 635 outward from the wall (upward in FIG. 6B), and forces the frame 710 outward from the wall, moving the deflector 750 to the proper position to deliver the fluid where it is needed. The fire protection sprinkler 600 further includes a guide pin 690 for helping to guide the slide plate 635 upon actuation of the fire protection sprinkler 600.

A ball 625, as shown in FIG. 6B, can be provided between two load screws 685*a* and 685*b* to act as a free spinning bearing. The ball 625 can reduce friction (torsion) during final assembly of the fire protection sprinkler 600, and in particular, when the load screws 685*a*, 685*b* are is torqued (screwed downwards) to impart deflection load to the spring washer 630.

FIGS. 8A to 8F show various views of the deflector 750. The deflector 750 may, if desired, be identical to that described in commonly-assigned U.S. Pat. No. 7,353,882, although the invention is not limited to use of that deflector. The deflector 750 may have a radically folded canopy portion 750*a* that has a minimal overhang over a vertical dispersion plate portion 750*b*. This can reduce the overall length of fire protection sprinkler 600, thus allowing the fire protection sprinkler 600 to fit within a space between 38 mm×89 mm studs (i.e., within a space between a nominal 2 inch by 4 inch stud).

Figure 7B:
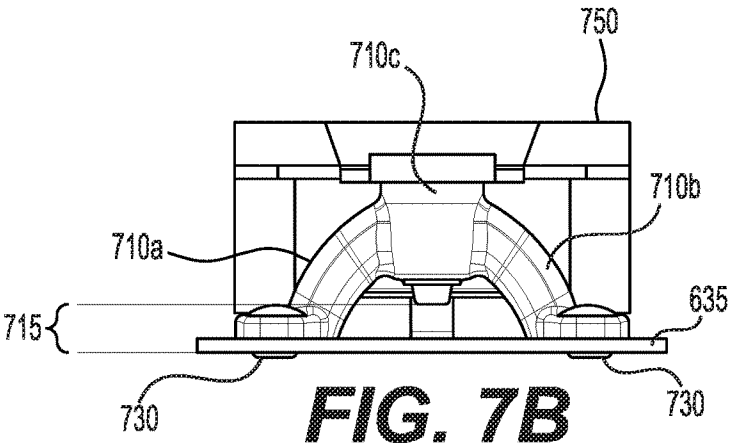
FIGS. 7A and 7B are a top view and a side view, respectively, of a sub-assembly including a deflector, a frame, and a slide plate of the horizontal sidewall fire protection sprinkler shown in FIGS. 6A to 6C, and FIGS. 7C and 7D are cross-sectional views taken along section lines 7C-7C and 7D-7D, respectively, of the subassembly shown in FIGS. 7A and 7B.
Figure 7D:
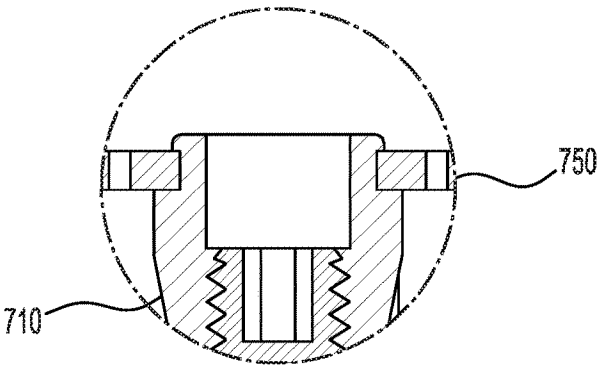
Figure 7A:
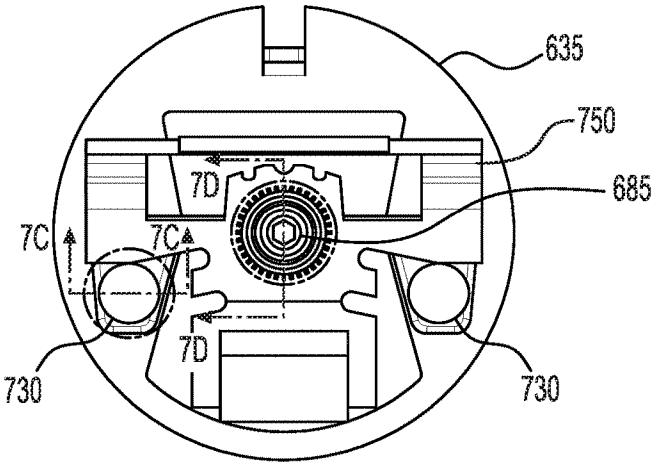
Figure 7C:
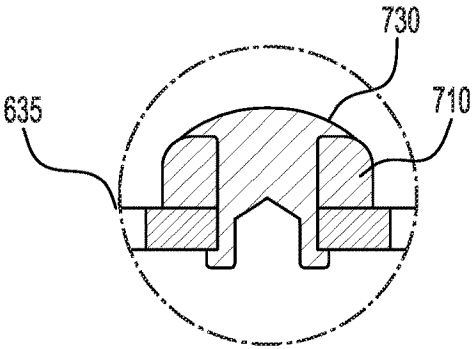
Figure 8A:
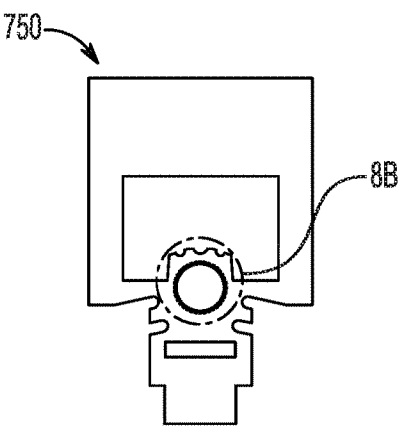
FIGS. 8A to 8F are a rear view, a detail view, a top view, a cross-sectional side view, a side view, and a front view respectively, of the deflector shown in FIGS. 7A to 7D. More specifically.
Figure 8B:
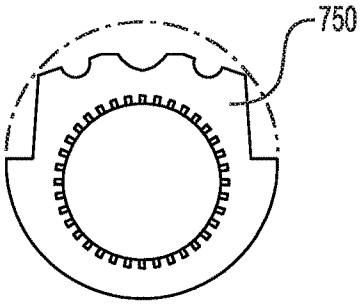
Figure 8C:
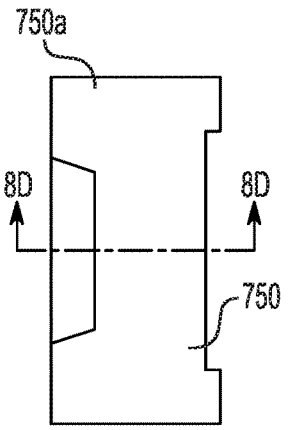
Figure 8D:
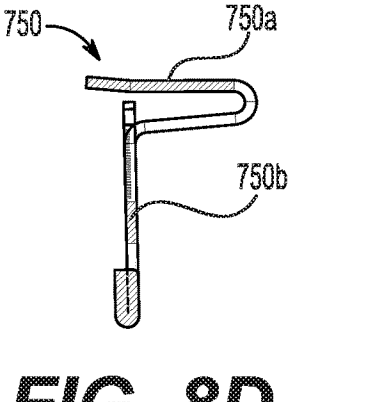
Figure 8E:
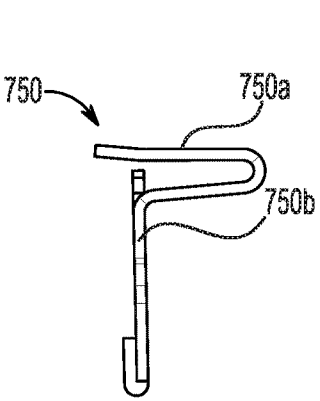
Figure 8F:
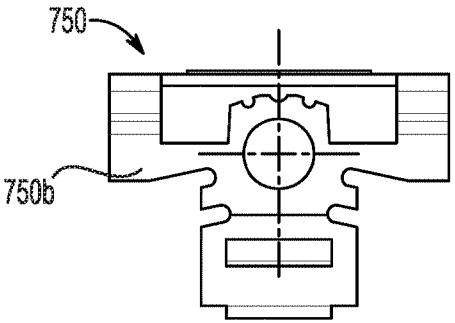
Figure 10B:
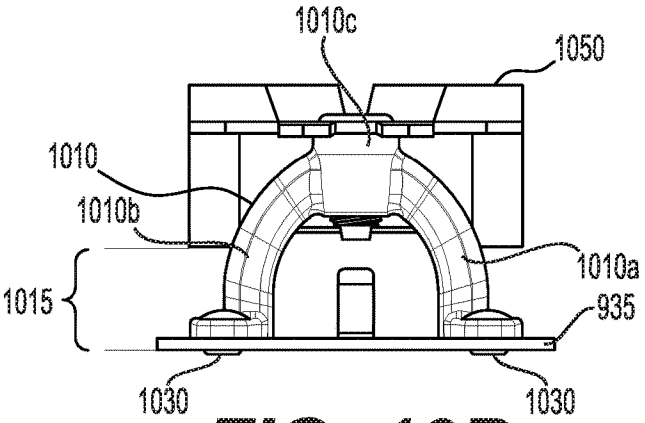
FIGS. 10A and 10B are a top view and a side view, respectively, of a subassembly including a deflector, a frame, and a slide plate of the horizontal sidewall fire protection sprinkler shown in FIGS. 9A to 9C, and FIGS. 10C and 10D are partial cross-sectional views taken along section lines 10C-10C and 10D-10D, respectively, of the subassembly shown in FIGS. 10A and 10B.
Figure 10D:
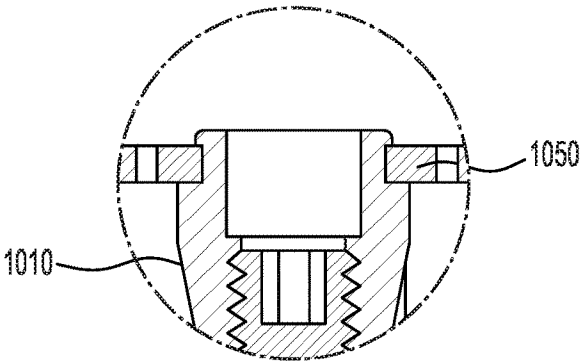
Figure 10A:
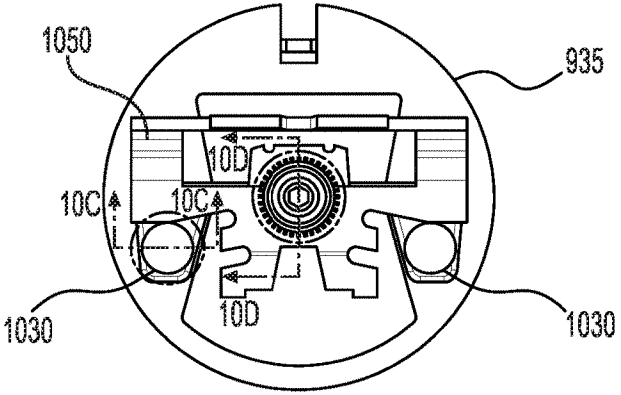
Figure 10C:
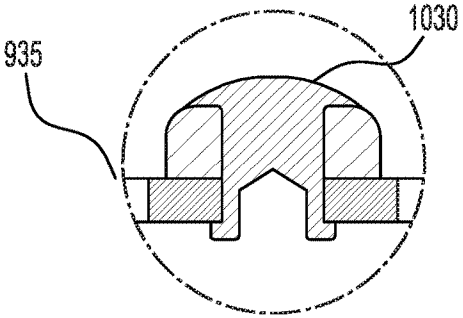
Figure 11A:
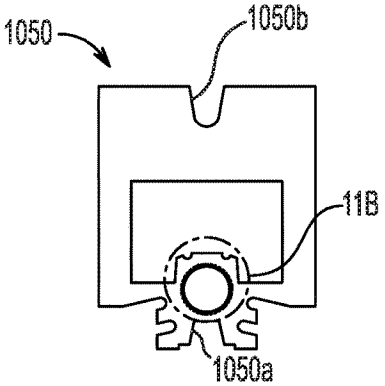
FIGS. 11A to 11F are a rear view, a detail view, a top view, a cross-sectional side view, a side view, and a front view, respectively, of the deflector shown in FIGS. 10A to 10D. More specifically.
Figure 11B:
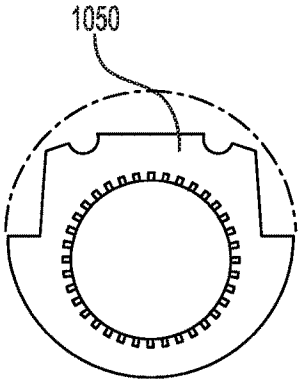
Figure 11C:
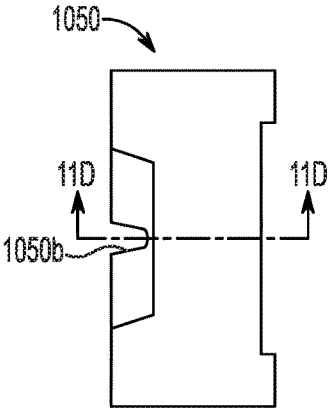
Figure 11D:
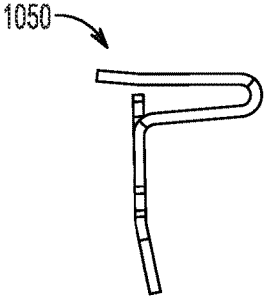
Figure 11E:
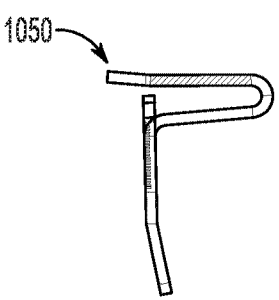
Figure 11F:
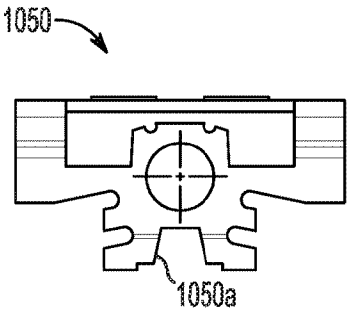

The frame arms 710, the load screw 685, and deflector attachment means, shown in Section 7D-7D in FIG. 7D, may, if desired, be similar to those described in Bulletin 033, "UL Listed F1 Residential Horizontal Sidewall Sprinkler", published by the Reliable Automatic Sprinkler Co., Inc., although the invention is not limited to use of the structure defined therein.

The fire protection sprinkler 600 is preferably a residential sidewall type fire protection sprinkler, as defined by NFPA 13, and can have a nominal K-factor of 4.2 gpm/psi$^{1/2}$. The fire protection sprinkler 600 is permitted for use in residential occupancies and can obtain a coverage area of 4.8 m by 6.10 (16 feet by 20 feet). Further technical details of the fire protection sprinkler 600 are provided below in Tables 3 and 4. Of course, our invention is not limited by the technical details provided in these tables, and the tables are merely examples of this embodiment.

TABLE 3

| ORIFICE SIZE | "K" FACTOR US | "K" FACTOR METRIC | THREAD SIZE | MAXIMUM AMBIENT TEMPERATURE | MAXIMUM WATER WORKING PRESSURE | SPRINKLER IDENTIFICATION NUMBER (SIN) | APPROVALS |
|---|---|---|---|---|---|---|---|
| ⅜" (9.6 mm) | 4.2 | 60 | ½" NPT (R½) | 100° F. (38° C.) | 175 PSI (12 bar) | RA4835 | cULus |

TABLE 4

| Listed Design Criteria | | | | | | | | | |
|---|---|---|---|---|---|---|---|---|---|
| MAX. COVERAGE AREA WIDTH × LENGTH | | DEFLECTOR TO CEILING DIMENSION | | FLOW RATE | | PRESSURE | | TEMPERATURE RATING | |
| FT. × FT. | M × M | INCHES | MM | GPM | L/MIN | PSI | BAR | SPRINKLER | COVER |
| 12 × 12 | 3.6 × 3.6 | 4-6 | 102-152 | 12 | 45.4 | 8.2 | 0.57 | 165° F. (74° C.) | 135° F. (57° C.) |
| 12 × 12 | 3.6 × 3.6 | 6-12 | 152-305 | 13 | 49.2 | 9.6 | 0.67 | | |
| 14 × 14 | 4.3 × 4.3 | 4-6 | 102-152 | 12 | 45.4 | 8.2 | 0.57 | | |
| 14 × 14 | 4.3 × 4.3 | 6-12 | 152-305 | 14 | 53.0 | 11.1 | 0.78 | | |
| 16 × 16 | 4.9 × 4.9 | 4-12 | 102-305 | 16 | 60.6 | 14.5 | 1.01 | | |
| 16 × 18 | 4.9 × 5.5 | 4-12 | 102-305 | 18 | 68.1 | 18.4 | 1.29 | | |
| 16 × 20 | 4.9 × 6.1 | 4-6 | 102-152 | 22 | 83.3 | 27.4 | 1.92 | | |
| 16 × 20 | 4.9 × 6.1 | 6-12 | 152-305 | 23 | 87.0 | 30.0 | 2.10 | | |

FIGS. 9A to 9C show a horizontal sidewall fire protection sprinkler 900 according to an additional embodiment. Similar to the fire protection sprinkler 600 discussed above, the fire protection sprinkler 900 includes a sprinkler body 910, an inlet passage 901, a sleeve body 915, and an outlet 912 sealed by a sealing assembly. The sealing assembly includes a spring washer 930 seated at the outlet 912, and a closure element 940 received in the spring washer 930 and sealing the outlet 912. The fire protection sprinkler 900 further includes a load screw 985, a yoke 960, two levers 970 and a soldered link 980. Each of these elements operates in a similar manner to the corresponding elements discussed above with respect to the fire protection sprinklers 1, 100, and 600.

The fire protection sprinkler 900 includes a slide plate 935 having a center aperture 935*a* for fitting over the outlet 912 of the sprinkler body 910. A subassembly 950, including a machined frame 1010 and a deflector 1050 (see FIGS. 10A to 10D), is attached to the slide plate 935. The frame 1010 is machined in the shape of a wishbone and has two arms 1010*a*, 1010*b* that are attached to the slide plate 935 via, for example, rivets 1030. A top portion 1010*c* of the frame 1010 opposite the two arms 1010*a*, 1010*b* is attached to the deflector 1050. A height from the slide plate 935 to a bottom side of the deflector 1050 is provided at reference numeral 1015. The fire protection sprinkler 900 differs from the fire protection sprinkler 600 in that the arms 1010*a*, 1010*b* of the frame 1010 are substantially larger than the size of a side of the deflector 1050 parallel to the arms 1010*a*, 1010*b* (e.g., the arms 1010*a*, 1010*b* of the frame 1010 may be twice the size of the deflector 1050).

A spring 920, for example, a conical spring, is provided between the slide plate 935 and an upper surface 910*c* of the sprinkler body 910 (towards the an upper surface of the sprinkler body 910 in FIG. 9B), and forces the slide plate 935 away from the sprinkler body 910. Fusion of the soldered link 980 results in the release of the levers 970, the yoke 960, the load screw 985, and the closure element 940, as each of these elements is forced out of and away from the fire protection sprinkler 900 by the force of the fluid. In addition, at this time, the spring 920 forces the slide plate 935 outward from the wall (upward in FIG. 9B), and forces the frame 1010 outward from the wall, moving the deflector 1050 to the proper position to deliver the fluid where it is needed. The fire protection sprinkler 900 further includes a guide pin 990 for helping to guide the slide plate 935 upon actuation of the fire protection sprinkler 900.

A ball 925, as shown in FIG. 9B, can be provided between two load screws 985*a*, 985*b* to act as a free spinning bearing. The ball 925 can reduce friction (torsion) during final assembly of the fire protection sprinkler 900, and in particular, when the load screws 985*a*, 985*b* are torqued (screwed downwards) to impart deflection load to the spring washer 930.

FIGS. 11A to 11F show various views of the deflector 1050. The deflector 1050 may be similar to the deflector 750 described above in connection with FIGS. 8A to 8F. Unlike the deflector 750, however, the deflector 1050 does not have an elongated double folded lower vertical dispersion plate. Instead, the deflector 1050 has a conical slot 1050*a*, shown in FIGS. 11A and 11F, and a small slot 1050*b* on the canopy (shown in FIGS. 11A and 11C). The foregoing features of the deflector 1050 can result in an optimized water distribution pattern for a coverage area of 3.05 m by 3.05 m (10 feet by 10 feet) in ordinary hazard applications.

The fire protection sprinkler 900 is preferably a sidewall standard spray fire protection sprinkler, as defined by NFPA 13, having a nominal K-factor of 5.6 gpm/psi$^{1/2}$, and is permitted for use in light hazard and ordinary hazard occupancies. The fire protection sprinkler 900 can obtain a standard coverage area, as defined by NFPA 13, of 4.27 m by 4.27 m (14 feet by 14 feet) for light hazard applications and 3.05 m by 3.05 m (10 feet by 10 feet) for ordinary hazard applications. Further technical details of the fire protection sprinkler 900 are provided below in Tables 5 and 6. Of course, our invention is not limited by the technical details provided in these tables, and the tables are merely examples of this embodiment.

TABLE 5

| NOMINAL ORIFICE SIZE | "K" FACTOR US | "K" FACTOR METRIC | THREAD SIZE | MAXIMUM WATER SERVICE PRESSURE |
|---|---|---|---|---|
| ½ inch (15 mm) | 5.6 | 80 | ½" NPT (R½) | 175 PSI (12 bar) |

TABLE 6

| SPRINKLER IDENTIFICATION NUMBER (SIN) | MAX. AMBIENT TEMPERATURE | SPRINKLER TEMPERATURE RATING | COVER PLATE TEMPERATURE RATING | APPROVAL |
|---|---|---|---|---|
| RA5035 | 100° F. (38° C.) | 165° F. (74° C.) | 135° F (57° C.) | cULus |

Further, while this disclosure has been described with respect to what are, at present, considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. A horizontal sidewall fire protection sprinkler configured (i) to change from a non-actuated state to an actuated state when ambient temperature in an occupancy reaches a predetermined temperature, and (ii), when in the actuated state, to receive a fluid from a fluid supply and to output the fluid to the occupancy in the actuated state, the fire protection sprinkler comprising:

(A) a sprinkler body having an inlet, an outlet, and an inner wall near the inlet, the inlet and the outlet defining a fluid passage;

(B) a sealing assembly that has an outer surface that is configured to seal the outlet of the sprinkler body when the sealing assembly is in a sealed state and the fire protection sprinkler is in the non-actuated state;

(C) a sleeve body, having (a) an inner end that is secured to an outer surface of the sprinkler body, and (b) an outer end with an opening;

(D) a yoke mounted in the opening of the sleeve body, the yoke substantially spanning a diameter of the opening of the sleeve body;

(E) a load screw configured to be positioned in a loaded position, in which the load screw is urged by the yoke toward the outer surface of the sealing assembly, thereby holding the sealing assembly in the sealed state when the fire protection sprinkler is in the non-actuated state;

(F) levers configured to move from (a) a retaining position, when the fire protection sprinkler is in the non-actuated state, in which the levers hold (i) the yoke in the opening of the sleeve body and (ii) the load screw in the loaded position, and (b) a released position, when the fire protection sprinkler is in the actuated state, in which the levers do not hold either of (i) the yoke in the opening of the sleeve body and (ii) the load screw in the loaded position;

(G) a soldered link configured (i) to maintain the levers in the retaining position when the fire protection sprinkler is in the non-actuated state, and (ii) to fail when ambient temperature in the occupancy reaches the predetermined temperature and the fire protection sprinkler is in the actuated state, thereby releasing the levers so that the levers move from the retaining position to the released position;

(H) a slide plate configured to move from (i) a retracted position near the inner wall of the sprinkler body when the fire protection sprinkler is in the non-actuated state, to (ii) an extended position near the outlet of the sleeve body, the slide plate having an outer surface, and a central aperture that surrounds a portion of the fluid passage of the sprinkler body when the slide plate is in the retracted position;

(I) a deflector support member that is connected to the outer surface of the slide plate and extends from the outer surface of the slide plate toward the opening at the outer end of the sleeve body;

(J) a deflector that is (i) mounted on the deflector support member and (ii) positioned between the load screw and the outer surface of the sealing assembly; and (K) a spring provided in the sprinkler body between the inner wall of the sprinkler body and the slide plate, the spring being configured to force (i) the slide plate, and (ii) the deflector support member away from the inner wall of the sprinkler body toward the opening of at the outer end of the sleeve body when the soldered link fails and the fire protection sprinkler is in the actuated state, wherein, when the fire protection sprinkler is in the actuated state, the deflector support member and the deflector protrude from outer end of the sleeve body.

2. The horizontal sidewall fire protection sprinkler of claim 1, wherein the deflector support member includes:

(a) at least one tower; and (b) at least one guide pin that is slidably retained in the at least one tower, and is configured to move from a retained position, in which the at least one guide pin is housed in the at least one tower, to an extended position, in which the at least one guide pin extends from the at least one tower, wherein the deflector is mounted to the at least one guide pin, wherein the slide plate has at least one aperture configured to retain that at least one guide pin and the at least one tower, and wherein, when the soldered link fails and the fire protection sprinkler is in the actuated state, the spring forces the at least one guide pin to move from the retained position to the extended position.

3. The horizontal sidewall fire protection sprinkler of claim 2, wherein a subassembly, including the at least one tower, the at least one guide pin, and the deflector, is configured to move:

(a) from (i) a housed position, in which the subassembly is housed within the sleeve body and the at least one guide pin is housed within the at least one tower, to (ii) a partially-protruded position, in which the at least one tower protrudes partly from the sleeve body, the at least one guide pin is in the retained position within the at least one tower, and the deflector is spaced from the sleeve body an initial protrusion distance; and (b) from (i) the partially-protruded position to (ii) a fully-protruded position, in which the at least one tower protrudes partly from the sleeve, the at least one guide pin is in the extended position, and the deflector is spaced from the sleeve body a final protrusion distance that is greater than the initial protrusion distance.

4. The horizontal sidewall fire protection sprinkler of claim 2, wherein the at least one guide pin is configured to be inserted through the at least one aperture on the slide plate and is secured to the slide plate with a nut.

5. The horizontal sidewall fire protection sprinkler of claim 1, wherein the sealing assembly comprises:

(a) a spring washer seated at the outlet of the sprinkler body; and (b) a closure element received in the washer and sealing the outlet of the sprinkler body, wherein, when the fire protection sprinkler is in the non-actuated state, the load screw retains the closure element and the spring washer in a sealed position in the outlet of the sprinkler body.

6. The horizontal sidewall fire protection sprinkler of claim 5, further comprising (L) a ball that is provided between the load screw and the closure element, wherein, when the fire protection sprinkler is in the non-actuated state, the load screw, via the ball and the closure element, causes the sprinkler washer to deflect.

7. The horizontal sidewall fire protection sprinkler of claim 1, wherein the sleeve body has a retaining flange that defines the opening at the outer end of the sleeve body, and wherein the yoke is self-centering and self-seating on the retaining flange, and has terraced tabs, including a top tab that serves as a vertical seating medium, a middle tab that serves as a horizontal centering medium with an inner diameter of the retaining flange, and a bottom tab that serves as a load bearing medium for the levers when the levers are in the retaining position.

8. The horizontal sidewall fire protection sprinkler of claim 1, further comprising:

(L) a diffuser, attached to the deflector and positioned between the load screw and the seal assembly, the diffuser including a convex solid portion positioned so that a center of the convex solid portion aligns with an axis of the fluid passage in the sprinkler body, wherein, when the fire protection sprinkler is in the non-actuated state, the diffuser transmits the force from the load screw to the seal assembly, and when the fire protection sprinkler is in the actuated state and outputs the fluid received from the fluid supply, the fluid strikes the convex solid portion of the diffuser.

9. The horizontal sidewall sprinkler of claim 8, wherein the deflector includes:

(a) a horizontally extending upper planar portion extending above the axis of the fluid passage; and (b) a vertical portion having an aperture that is positioned (i) above the convex solid portion of the diffuser and (ii) below the horizontally extending upper planar portion of the deflector relative to a direction of fluid flow along the axis of the fluid passage, wherein, when the fire protection sprinkler is in the actuated state, the fluid passes through the aperture of the vertical portion of the deflector.

10. The horizontal sidewall sprinkler of claim 9, wherein the vertical portion of the deflector has one or more peripheral apertures, each of the one or more peripheral apertures being positioned downstream from the convex solid portion of the diffuser relative to the direction of fluid flow along the axis of the fluid passage.

11. The horizontal sidewall fire protection sprinkler of claim 10, wherein a bottom edge of the vertical portion of the deflector includes a conical slot.

12. The horizontal sidewall fire protection sprinkler of claim 10, wherein an edge of the horizontally extending upper planar portion of the deflector that is closest to the sprinkler body includes a slot.

13. The horizontal sidewall fire protection sprinkler of claim 8, wherein the diffuser has an oblong shape.

14. The horizontal sidewall fire protection sprinkler of claim 8, wherein a length of the diffuser is greater than a width of the diffuser.

15. The horizontal sidewall fire protection sprinkler of claim 1, wherein the fire protection sprinkler is one of a residential sidewall fire protection sprinkler, a sidewall standard spray fire protection sprinkler, and an extended coverage sidewall spray fire protection sprinkler, and wherein the fire protection sprinkler is configured to be installed in an occupancy that is one of a residential occupancy, a light hazard occupancy, and an ordinary hazard occupancy.

16. The horizontal sidewall fire protection sprinkler of claim 1, wherein a nominal K-factor of the fire protection sprinkler is one of 4.2 gpm/psi$^{1/2}$, 5.6 gpm/psi$^{1/2}$, or 8.0 gpm/psi$^{1/2}$.

17. The horizontal sidewall fire protection sprinkler of claim 1, wherein a coverage area of the fire protection sprinkler is at least 2.44 meters by 2.44 meters and up to and including 4.88 meters by 6.10 meters.

18. The horizontal sidewall fire protection sprinkler of claim 1, wherein a coverage area of the fire protection sprinkler is at least 2.44 meters by 2.44 meters and up to and including 5.49 meters by 6.71 meters.

19. The horizontal sidewall fire protection sprinkler of claim 1, wherein a coverage area of the fire protection sprinkler is at least 2.44 meters by 2.44 meters and up to and including 4.88 meters by 7.32 meters.

20. The horizontal sidewall fire protection sprinkler of claim 1, wherein a minimum flow rate of the fire protection sprinkler is at least 45.42 liters per minute.

21. The horizontal sidewall fire protection sprinkler of claim 1, wherein a minimum flow rate of the fire protection sprinkler is at least 98.42 liters per minute.

22. The horizontal sidewall fire protection sprinkler of claim 1, wherein a minimum pressure of the fire protection sprinkler is at least 56.54 kilopascals.

23. The horizontal sidewall fire protection sprinkler of claim 1, wherein a minimum pressure of the fire protection sprinkler is at least 73.08 kilopascals.

24. The horizontal sidewall fire protection sprinkler of claim 1, wherein a minimum pressure of the fire protection sprinkler is 1206.58 kilopascals or less.

25. The horizontal sidewall fire protection sprinkler of claim 1, wherein the deflector support member comprises a frame that is wishbone shaped, the frame having two arms that are attached to the slide plate, and having a top portion that is attached to the deflector.

26. The horizontal sidewall fire protection sprinkler of claim 25, wherein a width of each of the arms of the frame is the equal to a width of a side of the deflector that is parallel to the arms of the frame.

27. The horizontal sidewall fire protection sprinkler of claim 26, wherein the fire protection sprinkler is configured to be installed in a wall of the occupancy, and wherein, when the fire protection sprinkler is in the non-actuated state, the fire protection sprinkler is configured to sit within a recess having a depth of 88.9 mm formed between 38 mm by 89 mm studs in the wall.

28. The horizontal sidewall fire protection sprinkler of claim 25, wherein the arms of the frame are attached to the slide plate by rivets.

29. The horizontal sidewall fire protection sprinkler of claim 25, wherein a width of each of the arms of the frame is greater than a width of a side of the deflector that is parallel to the arms of the frame.

30. The horizontal sidewall fire protection sprinkler of claim 1, wherein, when the soldered link fails and the fire protection sprinkler is in the actuated state:

(i) the levers are released from the retaining position to the released position, thereby releasing the yoke and the load screw, and a force of the fluid moves the yoke and the load screw out of and away from the fire protection sprinkler;

(ii) the force of the spring moves the slide plate outward, from the inner wall of the sprinkler body toward the opening of the sleeve body; and (iii) the force of the fluid moves the deflector away from the slide plate to a protruded position relative to the outer end of the sleeve body.

* * * * *